US009601826B2

(12) United States Patent
Ai et al.

(10) Patent No.: US 9,601,826 B2
(45) Date of Patent: Mar. 21, 2017

(54) MIMO ANTENNA, TERMINAL AND METHOD FOR IMPROVING ISOLATION

(71) Applicant: ZTE Corporation, Shenzhen, Guangdong (CN)

(72) Inventors: Hao Ai, Shenzhen (CN); Yan Shi, Shenzhen (CN); Long Li, Shenzhen (CN); Lu Zhang, Shenzhen (CN); Jun Xing, Shenzhen (CN); Hao Sun, Shenzhen (CN)

(73) Assignee: ZTE CORPORATION, Shenzhen, Guangdong (CN)

( * ) Notice: Subject to any disclaimer, the term of this patent is extended or adjusted under 35 U.S.C. 154(b) by 0 days.

(21) Appl. No.: 14/904,214

(22) PCT Filed: Nov. 26, 2013

(86) PCT No.: PCT/CN2013/087850

§ 371 (c)(1),
(2) Date: Feb. 16, 2016

(87) PCT Pub. No.: WO2014/161327

PCT Pub. Date: Oct. 9, 2014

(65) Prior Publication Data

US 2016/0254596 A1 Sep. 1, 2016

(30) Foreign Application Priority Data

Jul. 17, 2013 (CN) ..... 2013 1 0300672

(51) Int. Cl.

| | |
|---|---|
| ***H01Q 21/00*** | (2006.01) |
| ***H01Q 1/52*** | (2006.01) |
| ***H01Q 1/38*** | (2006.01) |
| ***H01Q 21/28*** | (2006.01) |
| ***H01Q 1/24*** | (2006.01) |

(Continued)

(52) U.S. Cl.
CPC ..... *H01Q 1/523* (2013.01); *H01Q 1/243* (2013.01); *H01Q 1/38* (2013.01); *H01Q 1/48* (2013.01);

(Continued)

(58) Field of Classification Search
CPC ..... H01Q 21/08; H01Q 1/246; H01Q 1/38; H01Q 3/26

(Continued)

(56) References Cited

U.S. PATENT DOCUMENTS

| | | | |
|---|---|---|---|
| 7,683,839 | B2 | 3/2010 | Ollikainen |
| 2008/0122698 | A1 | 5/2008 | Ollikainen |

(Continued)

FOREIGN PATENT DOCUMENTS

| | | | |
|---|---|---|---|
| CN | 202058854 | U | 11/2011 |
| CN | 202444054 | U | 9/2012 |

(Continued)

OTHER PUBLICATIONS

International Search Report in international application number: PCT/CN2013/087850, mailed on May 16, 2014.

(Continued)

*Primary Examiner* — Graham Smith
*Assistant Examiner* — Collin Dawkins
(74) *Attorney, Agent, or Firm* — Oppedahl Patent Law Firm LLC

(57) ABSTRACT

Disclosed are an MIMO antenna, a terminal and a method for improving MIMO antenna isolation. The MIMO antenna comprises at least two single antennas arranged on a printed circuit board (PCB); the single antenna comprising: an antenna support, a feeding grounding branch node used for shielding low-frequency coupling between the single antennas, a feeding point, a grounding point and an antenna radiation part, wherein the antenna support is arranged on the PCB, and the antenna radiation part is arranged on the (Continued)

antenna support; and the feeding grounding branch node is connected with the antenna radiation part via the feeding point and the grounding point.

16 Claims, 6 Drawing Sheets

(51) Int. Cl.
*H01Q 9/04* (2006.01)
*H01Q 1/48* (2006.01)

(52) U.S. Cl.
CPC ..... *H01Q 1/521* (2013.01); *H01Q 9/0421* (2013.01); *H01Q 21/28* (2013.01)

(58) Field of Classification Search
USPC ..... 343/853, 814, 816, 700 MS
See application file for complete search history.

(56) References Cited

U.S. PATENT DOCUMENTS

| | | | | |
|---|---|---|---|---|
| 2010/0156726 | A1* | 6/2010 | Montgomery | H01Q 7/00 343/700 MS |
| 2011/0298669 | A1 | 12/2011 | Rao | |
| 2013/0050027 | A1 | 2/2013 | Kim | |
| 2013/0162497 | A1* | 6/2013 | Satou | H01Q 5/35 343/853 |
| 2013/0241792 | A1* | 9/2013 | Ishikawa | H01Q 1/38 343/848 |
| 2014/0306856 | A1 | 10/2014 | Fan et al. | |

FOREIGN PATENT DOCUMENTS

| | | | |
|---|---|---|---|
| CN | 102916253 | A | 2/2013 |
| CN | 102931474 | A | 2/2013 |
| WO | 2008000891 | A1 | 1/2008 |
| WO | 2010028521 | A1 | 3/2010 |

OTHER PUBLICATIONS

English Translation of the Written Opinion of the International Search Authority in international application No. PCT/CN2013/087850, mailed on May 16, 2014.

Supplementary European Search Report in European application No. 13880899.3, mailed on Jun. 29, 2016.

* cited by examiner

MIMO ANTENNA, TERMINAL AND METHOD FOR IMPROVING ISOLATION

TECHNICAL FIELD

The present disclosure relates to a Multiple Input-Multiple Output technology in the antenna filed, and in particular, to a MIMO antenna, a terminal and a method for improving isolation.

BACKGROUND

With the continuous progress of modern communication technology, mobile terminal products have been applied more and more extensively. The antenna plays a more and more important role as a function support foundation and a main component of a mobile terminal.

Along with the rapid development of the third generation mobile communication technology (3G, 3rd Generation), the long term evolution (LTE) band which is as 3G evolution has gradually come into use. At the same time, the second generation mobile communication technology (2G, 2rd Generation) is still widely used. Accordingly, multi communication systems and multi bands coexist.

MIMO is a major breakthrough in smart antenna technology of wireless communications. As a core technology applied in a LTE project, i.e., a new generation wireless communication system, MIMO extends one dimensional smart antenna technology, has really high spectrum efficiency, doubles the communication system capacity without increasing the bandwidth, and enhances the channel reliability.

MIMO refers to a transmitter and a receiver of the signal system, which respectively uses multi transmitting antennas and multi receiving antennas. So the technology is called a multiple-transmitting-antennas-and-multiple-receiving-antennas technology.

At present, the types of antennas applied in mobile terminal products mainly include: monopole antennas, planar inverted-F antennas (PIFAs), loop antennas and so on. Multi-band operations can be achieved by the antennas and technology of coupled feeding, stub addition, slotting, and adjustment matching and so on. However, it is inevitable that the physical space for holding antennas is too large when the size of antennas working in a low-frequency band is too large. While the antenna that works based on a resonant circuit can work on the same frequency band with a relatively smaller size and achieve a high working efficiency. The working frequency bands of LTE include LTE Band 12 (698~746 MHz) which is lower than the Band of GSM850 (824~894 MHz), Band 13 (746~787 MHz) and Band 14 (758~798 MHz). The antenna which works based on a resonant circuit is a great choice if required to work well with such a small size within such a low frequency band. The space occupied by the antennas can be further reduced if the antennas which work based on resonant circuits (double parallel circuit resonance) are accepted in a high-frequency band. However, the interaction and coupling between antennas have presented a great challenge to small size MIMO antennas. There has been no effective method for improving isolation of MIMO antennas.

SUMMARY

To solve the problem, the embodiments of the present disclosure provide a MIMO antenna, a terminal and a method for improving isolation, which can improve isolation of the MIMO antennas while using the small size MIMO antennas.

In order to achieve above objectives, the technical scheme of the embodiments of the present disclosure is implemented as follows:

A multiple-input multiple-output (MIMO) antenna is provided, which includes at least two single antennas arranged on a printed circuit board (PCB); the single antenna includes: an antenna support, a feeding grounding branch node used for shielding low-frequency coupling between the single antennas, a feeding point, a grounding point and an antenna radiation part, wherein the antenna support is arranged on the PCB, and the antenna radiation part is arranged on the antenna support; and the feeding grounding branch node is connected with the antenna radiation part via the feeding point and the grounding point.

Here, the MIMO antenna may further include a dual inverted-L-shape printed stub arranged between the single antennas; and the dual inverted-L printed stub is configured to shield high-frequency coupling between the single antennas.

Here, when the feeding grounding branch node may be connected to the antenna radiation part via the feeding point, the feeding grounding branch node may be also configured to provide the antenna radiation part with a power feed source of the PCB and to provide the antenna radiation part with a ground voltage of the PCB.

Here, the antenna radiation part may include: a monopole part, a coupling gap, a coupling branch node, an open stub, and a grounding branch node;

the monopole part is connected to the feeding point, extends from the feeding point and along a front surface of the antenna support, changes its extending direction on to a top surface of the antenna support, and extends from the top surface of the antenna support to form a transverse radiation patch;

the coupling branch node is connected to the grounding branch node, and extends from the grounding branch node along the top surface of the antenna support to form a lateral branch node; the lateral branch node is separated from the transverse radiation patch of the monopole part via the coupling gap;

the open stub is connected to the grounding branch node, extends from the grounding branch node and along the top surface of the antenna support, and changes its extending direction on to a right surface of the antenna support; and the grounding branch node is connected to the coupling branch node and the open stub, extends from the top surface of the antenna support, change its extending direction on to the front surface of the antenna support, and then is connected to the feeding grounding branch node.

Here, the at least two single antennas of the MIMO antenna are arranged symmetrically on a top of the PCB.

A terminal is provided, which includes the abovementioned MIMO antenna.

A method for improving isolation of a MIMO antenna is provided, which arranges the MIMO antenna including at least two single antennas on a PCB, the method includes:

arranging an antenna support, a feeding grounding branch node used for shielding low-frequency coupling between the single antennas, a feeding point, a grounding point and an antenna radiation part; wherein the antenna support is arranged on the PCB, and the antenna radiation part is arranged on the antenna support; and the feeding grounding branch node is connected to the antenna radiation part via the feeding point and the grounding point.

Here, the method may further include:

arranging a dual inverted-L printed stub between the single antennas;

shielding high-frequency coupling between the single antennas via the dual inverted-L printed stub.

Here, the method may further include:

when the feeding grounding branch node is connected to the antenna radiation part via the feeding point, providing, by the feeding grounding branch node, a power feed source of the PCB to the antenna radiation part, and providing, by the feeding grounding branch node, a ground voltage of the PCB to the antenna radiation part.

Here, the method may further include:

radiating a low-frequency broad band by a monopole part, a coupling gap, a coupling branch node of the antenna radiation part;

radiating a high-frequency broad band by the monopole part, the coupling gap, an open stub, and a grounding branch node of the antenna radiation part.

According to the MIMO antenna, the terminal and the method for improving isolation recorded by embodiments of the present disclosure, the MIMO antenna includes at least two single antennas arranged on a printed circuit board (PCB); the single antenna includes: an antenna support, a feeding grounding branch node used for shielding low-frequency coupling between the single antennas, a feeding point, a grounding point and an antenna radiation part, wherein the antenna support is arranged on the PCB, and the antenna radiation part is arranged on the antenna support; and the feeding grounding branch node is connected with the antenna radiation part via the feeding point and the grounding point. In this way, low-frequency coupling between the single antennas can by shielded by the feeding grounding branch node, and high-frequency coupling between the single antennas can by shielded by the dual inverted-L-shape printed stub, thereby improving the isolation of MIMO antenna.

Preferably, the antenna radiation part includes a monopole part, a coupling gap, a coupling branch node, an open stub, and a grounding branch node; the monopole part is connected to the feeding point, extends from the feeding point and along a front surface of the antenna support, changes its extending direction on to a top surface of the antenna support, and extends from the top surface of the antenna support to form a transverse radiation patch; the coupling branch node is connected to the grounding branch node, and extends from the grounding branch node along the top surface of the antenna support to form a lateral branch node; the lateral branch node is separated from the transverse radiation patch of the monopole part via the coupling gap; the open stub is connected to the grounding branch node, extends from the grounding branch node and along the top surface of the antenna support, and changes its extending direction on to a right surface of the antenna support; and the grounding branch node is connected to the coupling branch node and the open stub, extends from the top surface of the antenna support, change its extending direction on to the front surface of the antenna support, and then is connected to the feeding grounding branch node. In this way, a small size MIMO antenna is implemented by a double parallel circuit resonance which is corresponding to the transverse radiation patch.

1: PCB; 2*a*, 2*b*: antenna support; 3*a*, 3*b*: feeding grounding branch node; 4*a*, 4*b*: feeding point; 5*a*, 5*b*: antenna radiation part; 6*a*, 6*b*: dual inverted-L printed stub; 51*a*, 51*b*: monopole part; 52*a*, 52*b*: coupling gap; 53*a*, 53*b*: coupling branch node; 54*a*, 54*b*: grounding branch node; 55*a*, 55*b*: open stub.

DETAILED DESCRIPTION OF THE EMBODIMENTS

The description on the implementation of the embodiments of the present disclosure would be made in detail in combination with the drawings for making the features and technology of the embodiments of the present disclosure understood more clearly. The appended drawings are just for reference, rather than for limiting the embodiments of the present disclosure.

The embodiments of the present disclosure provide a broadband MIMO antenna which is based on a double parallel circuit resonance. The MIMO antenna includes at least two single antennas arranged on a printed circuit board (PCB); the single antenna includes an antenna support, a feeding grounding branch node used for shielding low-frequency coupling between the single antennas, a feeding point, a grounding point and an antenna radiation part, wherein the antenna support is arranged on the PCB, and the antenna radiation part is arranged on the antenna support; and the feeding grounding branch node is connected with the antenna radiation part via the feeding point and the grounding point.

Figure 1:
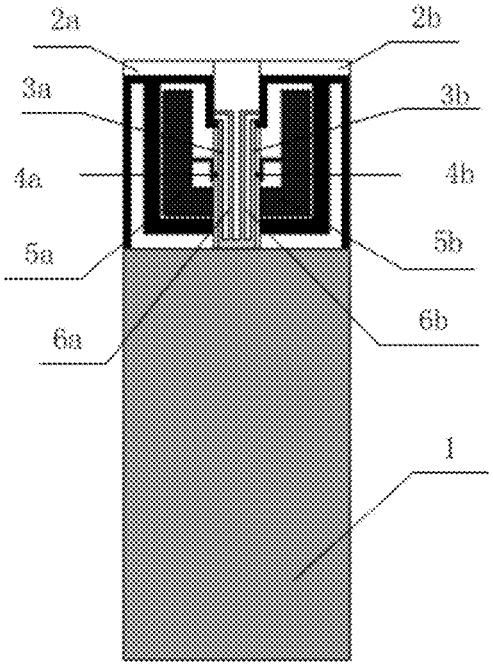
FIG. 1 is a top view schematic diagram of the MIMO antenna according to an embodiment of the present disclosure.
Figure 2:
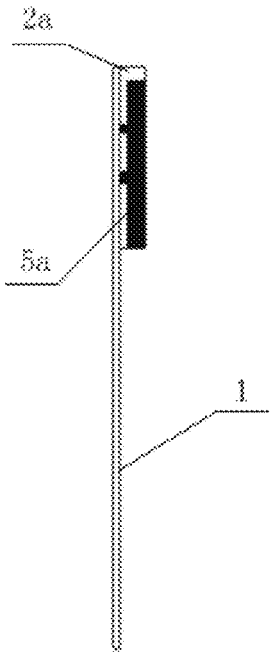
FIG. 2 is a left view schematic diagram of the MIMO antenna according to an embodiment of the present disclosure.

FIG. 1 is a top view schematic diagram of the MIMO antenna according to an embodiment of the present disclosure. FIG. 2 is a left view schematic diagram of the MIMO antenna according to an embodiment of the present disclosure. As shown in FIG. 1 and FIG. 2, the MIMO antenna consists of two single antennas arranged on PCB 1. In order to distinguish the components of the two single antennas, all components of one single antenna is represented by symbol a and all components of the other single antenna is represented by symbol b. Because a component structure of two single antennas is exactly the same, the embodiments of present disclosure illustrate the single antenna which is represented by symbol b only. For the single antenna which is represented by symbol b, the single antenna includes an antenna support 2*b*, a feeding grounding branch node 3*b* used for shielding the low-frequency coupling between the single antennas, a feeding point 4*b*, a grounding point and an antenna radiation part 5*b*; wherein, the antenna support 2*b* is arranged on the PCB 1, and the antenna radiation part 5*b* is arranged on the antenna support 2*b*; and the feeding grounding branch node 3*b* is connected with the antenna radiation part 5*b* via the feeding point 4*b* and the grounding point.

Preferably, the MIMO antenna further includes a dual inverted-L-shape printed stub 6*b* arranged between the single antennas; and the dual inverted-L printed stub 6*b* is configured to shield high-frequency coupling between the single antennas.

Preferably, when the feeding grounding branch node 3*b* is connected to the antenna radiation part 5*b* via the feeding point 4*b*, the feeding grounding branch node is also configured to provide the antenna radiation part 5*b* with a power feed source of the PCB 1 and to provide the antenna radiation part 5*b* with a ground voltage of the PCB 1

Preferably, the antenna radiation part 5*b* includes: a monopole part 51*b*, a coupling gap 52*b*, a coupling branch node 53*b*, a grounding branch node 54*b* and an open stub 55*b*; and wherein:

the monopole part 51*b* is connected to the feeding point 4*b*, extends from the feeding point 4*b* and along a front surface of the antenna support, changes its extending direction on to a top surface of the antenna support, and extends from the top surface of the antenna support to form a transverse radiation patch;

the coupling branch node 53*b* is connected to the grounding branch node 54*b*, and extends from the grounding branch node 54*b* along the top surface of the antenna support to form a lateral branch node; the lateral branch node is separated from the transverse radiation patch of the monopole part via the coupling gap 52*b;* the open stub 55*b* is connected to the grounding branch node 54*b*, extends from the grounding branch node 54*b* and along the top surface of the antenna support, and changes its extending direction on to a right surface of the antenna support; and the grounding branch node 54*b* is connected to the coupling branch node 53*b* and the open stub 55*b*, extends from the top surface of the antenna support, change its extending direction on to the front surface of the antenna support, and then is connected to the feeding grounding branch node 3*b*.

Preferably, the open stub 55*b* is folded from the top surface of the antenna support to the back surface of the antenna support; in this way, the frequency point of low-frequency operation can be reduced.

Preferably, two single antennas of the MIMO antenna are arranged symmetrically on a top of the PCB.

The embodiment of present disclosure arranges two single antennas to form the MIMO antenna. It is also possible to arrange other number of single antennas to form the MIMO antenna in practice. Preferably, the at least two single antennas of the MIMO antenna are arranged symmetrically on a top of the PCB.

Figure 3:
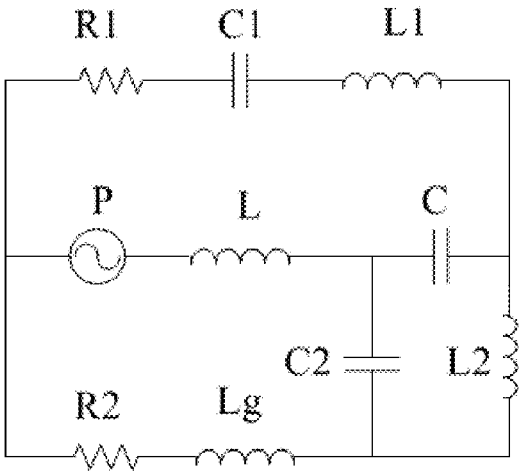
FIG. 3 is a schematic diagram of an equivalent circuit of the single antenna of the MIMO antenna according to an embodiment of the present disclosure.

FIG. 3 is a schematic diagram of an equivalent circuit of a single antenna of the MIMO antenna according to an embodiment of the present disclosure. As shown in FIG. 3, the equivalent circuit of the single antenna includes two parallel resonant circuits. The first resonant circuit includes inductance L, gap capacitance C, series connection inductance L1 and capacitance C1, radiation resistance R1; the second resonant circuit includes inductance L, gap capacitance C, series connection inductance L2, coupling capacitance C2 and radiation resistance R2; P is a signal source.

Figure 4:
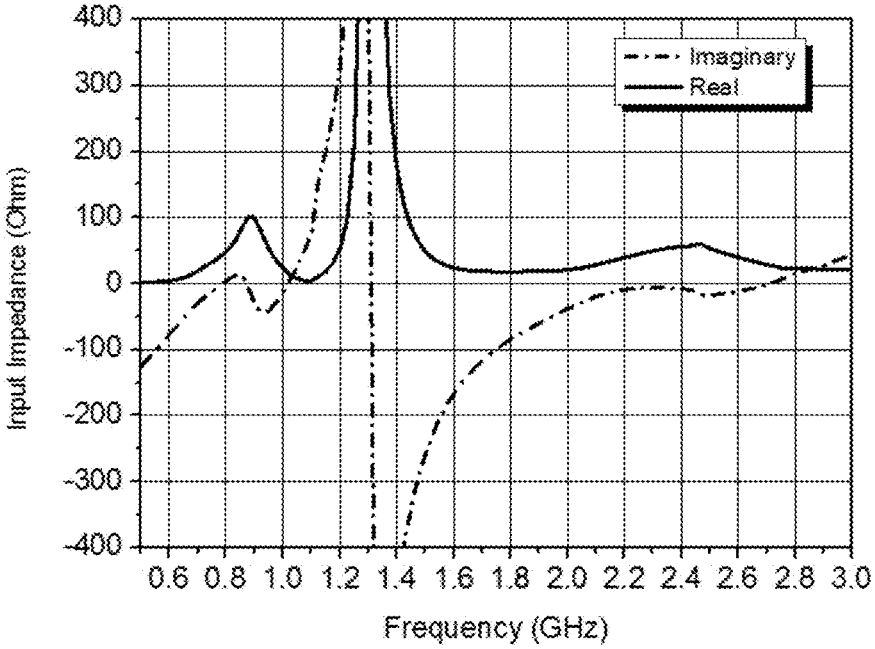
FIG. 4 is an impedance diagram of the single antenna in a MIMO antenna according to an embodiment of the present disclosure.

The monopole parts 51*a*, 51*b* of the single antennas each is equivalent to the inductance L; the coupling gaps 52*a*, 52*b* each is equivalent to the series connection inductance L1 and capacitance C1; in this way, the first resonant circuit is formed. The first resonant circuit produces a broadband in low-frequency by the radiation resistance R1 which is equated to each of the open stubs 55*a*, 55*b*. The broadband in low-frequency is corresponding to a low frequency band which is shown in the impedance diagram of FIG. 4.

The second resonant circuit is connected with the first resonant circuit in parallel. The grounding branch node 54*a*, 54*b* each is equivalent to the series connection inductance L2 and coupling capacitance C2; inductance L2 and capacitance C2 are parallel with gap capacitance C; the second resonant circuit produces a broadband in high-frequency by radiation resistance R2 which is equated to the each of grounding branch nodes 54*a*, 54*b*. The broadband in high-frequency is corresponding to a high frequency band which is shown in the impedance diagram of FIG. 4. Here, Lg is part of inductance after the coupling capacitance C2 is made due to the coupling between the grounding branch node 54*a*, 54*b* and the monopole part.

Under the influence of two resonant circuits, the total working band of the single antenna becomes broader. The single antenna can realize an independence and adjustment in high and low frequency operations by changing parameters when using two resonant circuits to realize the operations in high frequency and low frequency at the same time.

Figure 5:
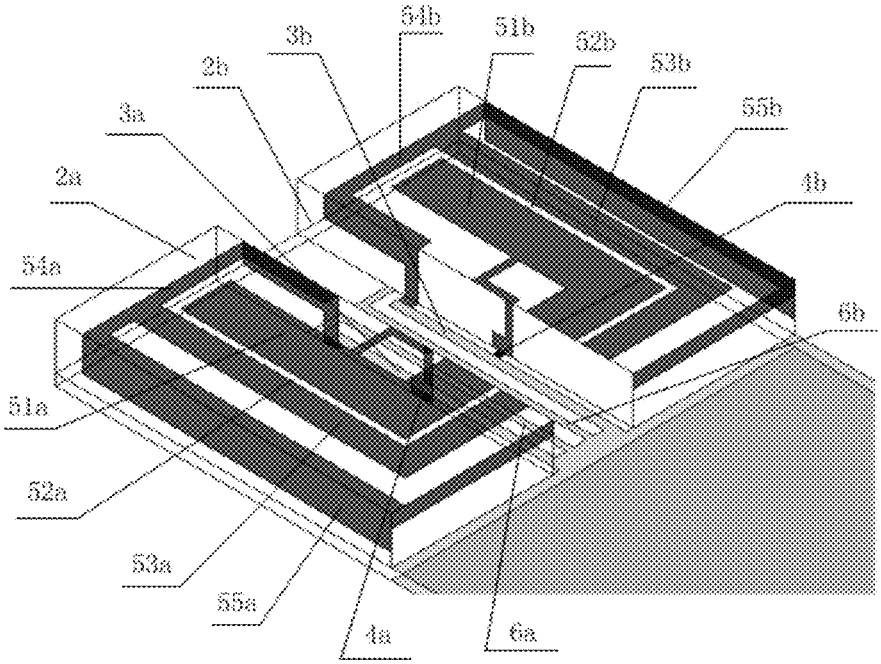
FIG. 5 is a schematic diagram of the three-dimensional structure of the MIMO antenna according to the first embodiment of the present disclosure.

When the work platform of the MIMO antenna is a wireless data card, an embodiment of present disclosure also describes a MIMO antenna which is applicable to a wireless data card. As shown in FIG. 5, geometrical dimensions accepted by the MIMO antenna of this embodiment are: the dielectric constant of PCB 1 is 4.5; the thickness is 0.8 mm; the width is 30 mm; the length is 80 mm. The length of each of supports 2*a* and 2*b* is 25 mm; the width of each of supports 2*a* and 2*b* are 12 mm; the height of each of supports 2*a* and 2*b* are 3.5 mm; the supports 2*a* and 2*b* each is hollow; the wall thickness of each of support 2*a* and support 2*b* is 1.4 mm; the dielectric constant of each of support 2*a* and support 2*b* is 3.5. The diameter of the feeding part of each of the monopole parts 51*a* and 51*b* is 0.5 mm; the radiation patch consists of two parts, which are a rectangular patch with 3.7 mm width and 13 mm length and a folded patch with 6.7 mm length. The coupling gaps 52*a*, 52*b* that between the monopoles 51*a*, 51*b* and coupling branch nodes 53*a*, 53*b* are respectively 0.1 mm. The width of each of coupling branch nodes 53*a* and 53*b* is 3 mm; the total length of each of coupling branch nodes 53*a* and 53*b* is 27.6 mm. The open stubs 55*a* and 55*b* each includes two stubs: one stub extends to the back of the antenna support 2*a* or 2*b* and has 2.2 mm length and 1 mm width; and the other stub extends to a side of the antenna support 2*a* or 2*b* and has transverse length of 23 mm; the width of the back of each of antenna support 2*a* and 2*b* is 2.5 mm; the width of the top surface of each of antenna support 2*a* and 2*b* is 1 mm; the width of the side portion of each of antenna support 2*a* and 2*b* is 1 mm. The grounding branch nodes 54*a*, 54*b* which are respectively folded from the top surfaces of the antenna supports 2*a*, 2*b* to the front surfaces of the antenna supports 2*a*, 2*b* are respectively directly connected to the feeding grounding branch nodes 3*a*, 3*b*; the width of each of the grounding branch nodes 54*a*, 54*b* is 1 mm, but the width of the part that is folded to support's front surface is 1.5 mm.

The length of each of the feeding grounding branch nodes 3*a*, 3*b* is 17 mm; the width of each of the feeding grounding branch nodes 3*a*, 3*b* is 0.3 mm. The width of each of dual inverted-L printed stubs 6*a*, 6*b* is 0.5 mm.

Figure 6:
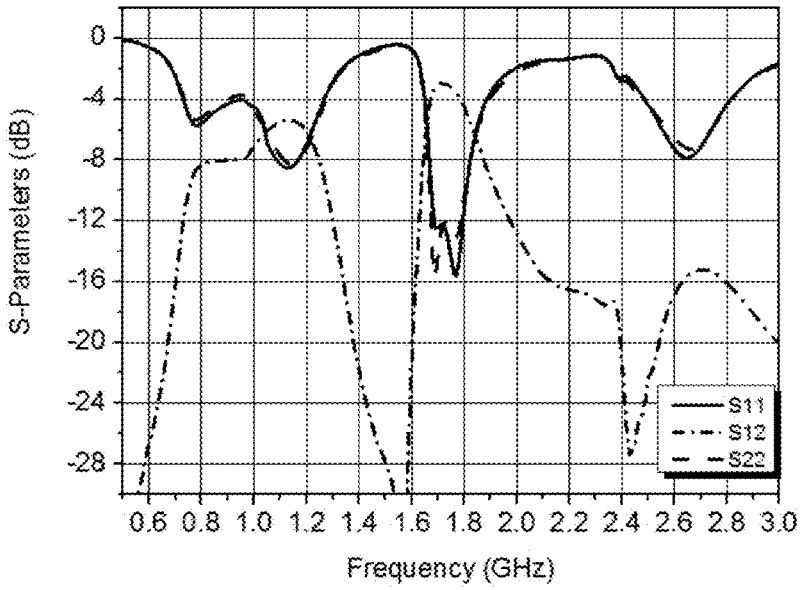
FIG. 6 is a schematic diagram of the S parameters of the MIMO antenna according to the first embodiment of the present disclosure.
Figure 7:
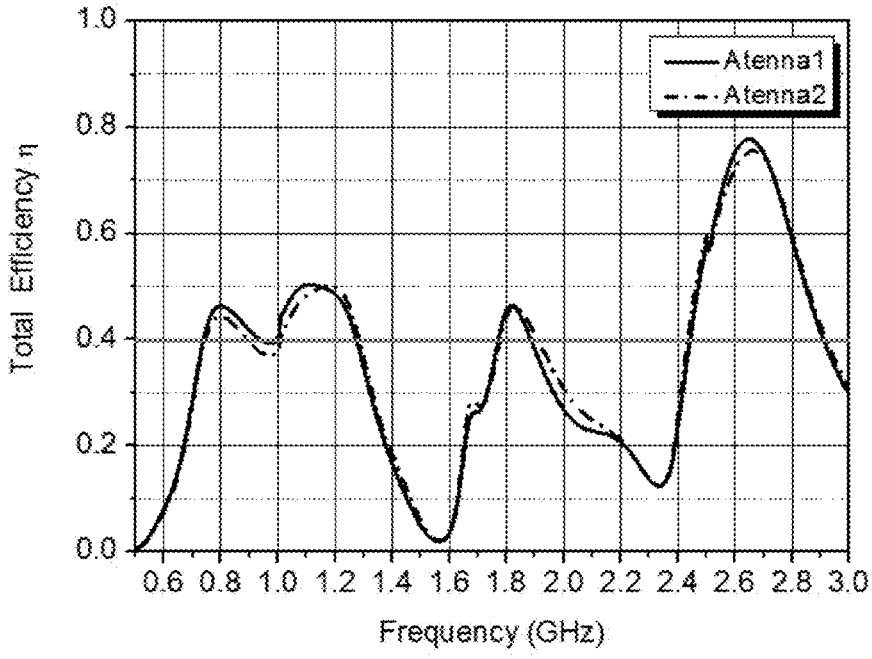
FIG. 7 is a schematic diagram of the overall efficiency of the MIMO antenna according to the first embodiment of the present disclosure.

Combined with the parameters of the present embodiment, the S parameter of a working MIMO antenna is shown as FIG. 6. Since the MIMO antenna has two single antennas, there are two entrances and exits, which are represented by 1 and 2. S11 represents that a signal enters from 1, and the signal exits from 1. S22 represents that a signal enters from 2, and the signal exits from 2. S12 represents that a signal enters from 1, and the signal exits from 2, from which it can be seen that S12 represents an isolation value. And the change of the isolation value of S12 with frequency can be seen from FIG. 6. The low-frequency covers 746~960 MHz, and the isolation reaches −8 dB. The high-frequency covers 2500~2750 MHz, and the isolation is smaller than −15 dB. The MIMO antenna meets the requirement of high isolation in both high-frequency and low-frequency work situations. And it can be seen from FIG. 7 that when the low-frequency covers 746~960 MHz and the high-frequency covers 2500~2750 MHz, the work efficiency of each of the two single antennas is high.

Figure 8:
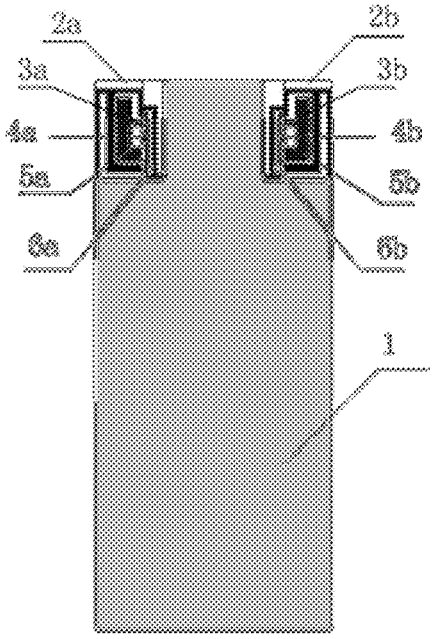
FIG. 8 is a top view schematic diagram of the MIMO antenna according to the second embodiment of the present disclosure.
Figure 9:
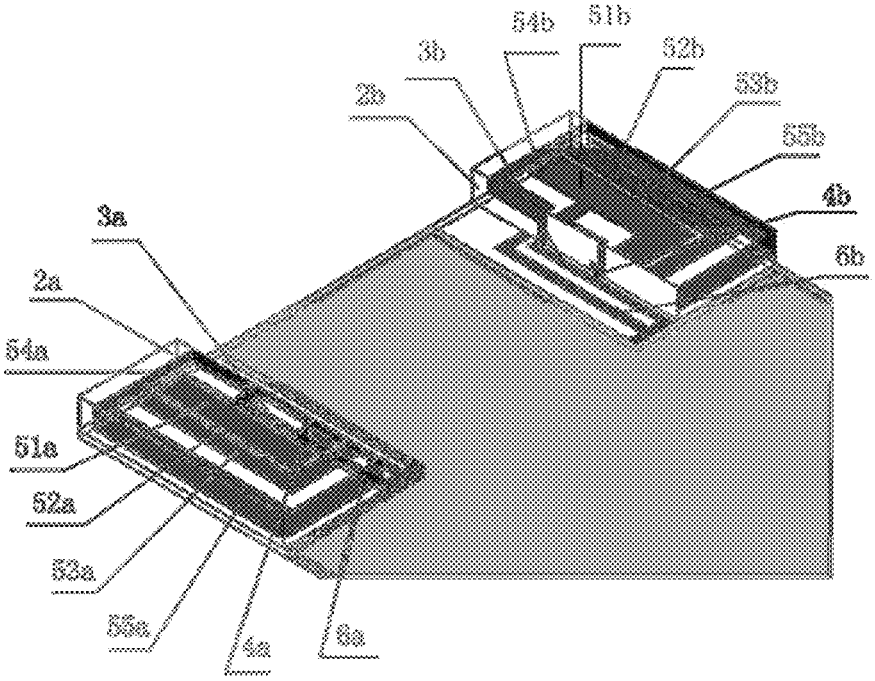
FIG. 9 is a schematic diagram of the three-dimensional structure of the MIMO antenna according to the second embodiment of the present disclosure.

When the work platform of the MIMO antenna is a mobile phone, an embodiment of present disclosure also describes a MIMO antenna which is applicable to a mobile phone. As shown in FIG. 8 and FIG. 9, geometrical dimensions adopted by the MIMO antenna of this embodiment are: the dielectric constant of PCB 1 is 4.5; the thickness is 0.8 mm; the width is 60 mm; the length is 140 mm. The length of each of supports 2*a* and 2*b* is 25 mm; the width of each of supports 2*a* and 2*b* is 12 mm; the height of each of supports 2*a* and 2*b* is 3.5 mm; the supports 2*a* and 2*b* each is hollow; the wall thickness of each of supports 2*a* and support 2*b* is 1.4 mm; the dielectric constant of each of supports 2*a* and support 2*b* is 3.5. The diameter of the feeding part of each the monopole parts 51*a* and 51*b* is 0.5 mm; the radiation patch consists of two parts, which are a rectangular patch and a folded patch, wherein the width of the rectangular patch is 3.7 mm, the length of the rectangular patch is 13 mm, and the length of the folded patch is 6.7 mm. The coupling gaps 52*a*, 52*b* between the monopoles 51*a*, 51*b* and coupling branch nodes 53*a*, 53*b* are respectively 0.1 mm. The width of each of coupling branch nodes 53*a* and 53*b* is 0.5 mm; the total length of each of coupling branch nodes 53*a* and 53*b* is 25.1 mm. The open stubs 55*a* and 55*b* each includes two stubs: one stub extends to the back of the antenna support 2*a* or 2*b* and has 4.7 mm length and 1 mm width; the other stub extends to a side of the antenna support 2*a* or 2*b* and has transverse length of 23 mm; the width of each of the antenna supports 2*a* and 2*b* is 2.5 mm; the width of the top surface of each of the antenna supports 2*a* and 2*b* is 1 mm; the width of the side portion of the antenna supports 2*a* and 2*b* is 1 mm. The grounding branch nodes 54, 54*b* which are respectively folded from the top surfaces of the antenna supports 2*a*, 2*b* to the front surfaces of the antenna supports 2*a*, 2*b* are respectively directly connected to the feeding grounding branch nodes 3*a*, 3*b*; the width of each of the grounding branch nodes 54*a*, 54*b* is 1 mm, but the width of the part that is folded to support's front surface is 1.5 mm.

The length of each of the feeding grounding branch nodes 3*a*, 3*b* is 17 mm; the width of each of the feeding grounding branch nodes 3*a*, 3*b* is 0.3 mm. The width of each of dual inverted-L printed stubs 6*a*, 6*b* is 0.5 mm.

Figure 10:
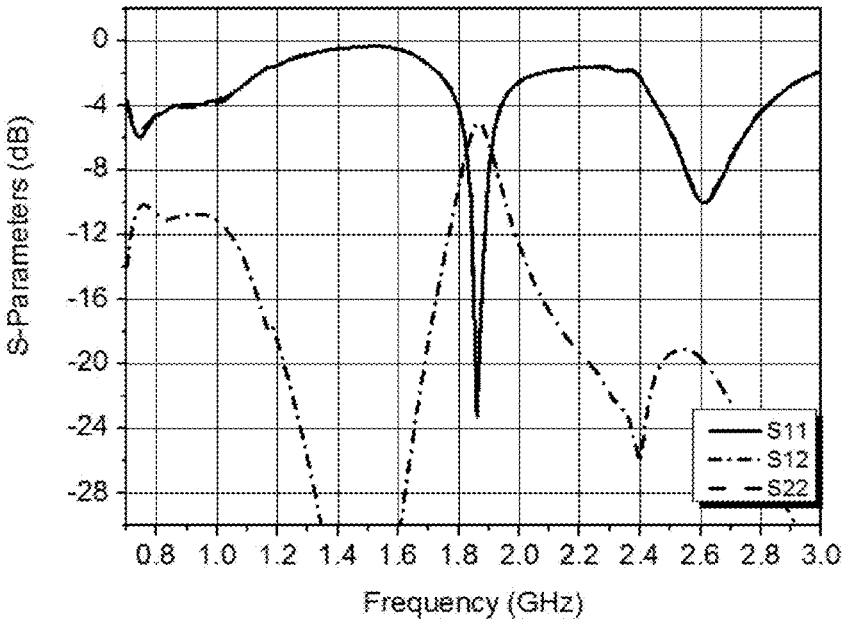
FIG. 10 is a schematic diagram of the S parameters of the MIMO antenna according to the second embodiment of the present disclosure.
Figure 11:
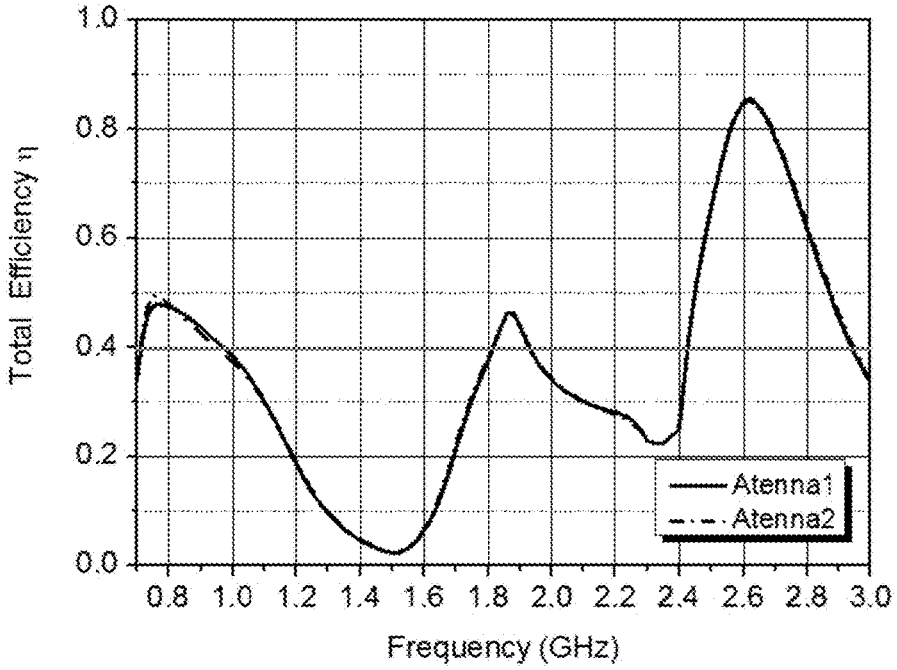
FIG. 11 is a schematic diagram of the overall efficiency of the MIMO antenna according to the second embodiment of the present disclosure.

Combined with the parameters of the present embodiment, the S parameter of a working MIMO antenna is shown as FIG. 6. And the change of the isolation value of S12 with frequency can be seen from FIG. 10. The low-frequency covers 746~960 MHz, and the isolation reaches −10 dB. The high-frequency covers 2500~2750 MHz, and the isolation is smaller than −18 dB. The MIMO antenna meets the requirement of high isolation in both high-frequency and low-frequency work situations. And it can be seen from FIG. 11 that when the low-frequency covers 746~960 MHz and the high-frequency covers 2500~2750 MHz, the work efficiency of each of the two single antennas is high.

An embodiment of the present disclosure also describes a terminal which includes the abovementioned MIMO antenna.

Figure 12:
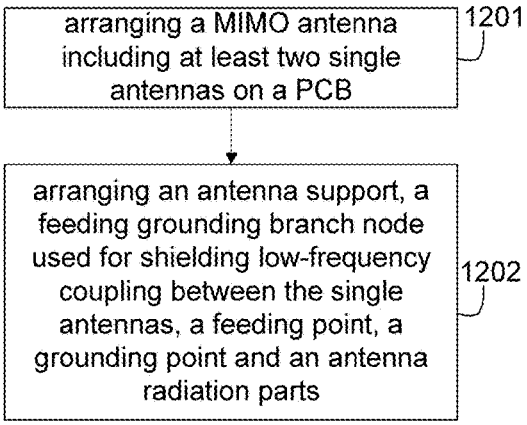
FIG. 12 is a schematic diagram of the flow of a method for improving isolation of MIMO antenna according to an embodiment of the present disclosure.

An embodiment of the present disclosure also describes a method for improving isolation of a MIMO antenna, as shown in FIG. 12. The method includes following steps:

Step S1201: arranging a MIMO antenna including at least two single antennas on a PCB; and Step S1202: arranging an antenna support, a feeding grounding branch node used for shielding low-frequency coupling between the single antennas, a feeding point, a grounding point and an antenna radiation parts.

Here, the antenna support is arranged on the PCB, and the antenna radiation part is arranged on the antenna support; and the feeding grounding branch node is connected to the antenna radiation part via the feeding point and the grounding point.

Preferably, the method also includes:

arranging a dual inverted-L printed stub between the single antennas;

shielding the high-frequency coupling between the single antennas via the dual inverted-L printed stub.

Preferably, the method also includes that: when the feeding grounding branch node is connected to the antenna radiation part via the feeding point, the feeding grounding branch node provides a power feed source of the PCB to the antenna radiation part, and provides a ground voltage of the PCB to the antenna radiation part.

Preferably, the method includes that:

a low-frequency broad band is radiated by a monopole part, a coupling gap, a coupling branch node of the antenna radiation part;

a high-frequency broad band is radiated by the monopole part, the coupling gap, an open stub, and a grounding branch node of the antenna radiation part.

The person skilled in art should understand that the method for improving isolation of a MIMO antenna as shown in FIG. 12 may be appreciated by the relevant description of the component structure of the above MIMO antenna.

The described above are only preferred embodiments of the present disclosure, rather than used to limit the protection for the present disclosure.

What is claimed is:

1. A multiple-input multiple-output (MIMO) antenna, comprising at least two single antennas arranged on a printed circuit board (PCB); the single antenna comprising: an antenna support, a feeding grounding branch node used for shielding low-frequency coupling between the single antennas, a feeding point, a grounding point and an antenna radiation part, wherein the antenna support is arranged on the PCB, and the antenna radiation part is arranged on the antenna support; and the feeding grounding branch node is connected with the antenna radiation part via the feeding point and the grounding point;

wherein the antenna radiation part comprises a monopole part, a coupling gap, a coupling branch node, an open stub, and a grounding branch node; wherein:

the monopole part is connected to the feeding point, extends from the feeding point and along a front surface of the antenna support, changes its extending direction on to a top surface of the antenna support, and extends from the top surface of the antenna support to form a transverse radiation patch;

the coupling branch node is connected to the grounding branch node, and extends from the grounding branch node along the top surface of the antenna support to form a lateral branch node; the lateral branch node is separated from the transverse radiation patch of the monopole part via the coupling gap;

the open stub is connected to the grounding branch node, extends from the grounding branch node and along the top surface of the antenna support, and changes its extending direction on to a right surface of the antenna support; and the grounding branch node is connected to the coupling branch node and the open stub, extends from the top surface of the antenna support, change its extending direction on to the front surface of the antenna support, and then is connected to the feeding grounding branch node.

2. The MIMO antenna according to claim 1, further comprising a dual inverted-L-shape printed stub arranged between the single antennas; and the dual inverted-L printed stub is configured to shield high-frequency coupling between the single antennas.

3. The MIMO antenna according to claim 2, wherein the at least two single antennas of the MIMO antenna are arranged symmetrically on a top of the PCB.

4. The MIMO antenna according to claim 1, wherein, when the feeding grounding branch node is connected to the antenna radiation part via the feeding point, the feeding grounding branch node is also configured to provide the antenna radiation part with a power feed source of the PCB and to provide the antenna radiation part with a ground voltage of the PCB.

5. The MIMO antenna according to claim 4, wherein the at least two single antennas of the MIMO antenna are arranged symmetrically on a top of the PCB.

6. The MIMO antenna according to claim 1, wherein the at least two single antennas of the MIMO antenna are arranged symmetrically on a top of the PCB.

7. A terminal, comprising a multiple-input multiple-output (MIMO) antenna, wherein the MIMO antenna comprises at least two single antennas arranged on a printed circuit board (PCB); the single antenna comprises: an antenna support, a feeding grounding branch node used for shielding low-frequency coupling between the single antennas, a feeding point, a grounding point and an antenna radiation part, wherein the antenna support is arranged on the PCB, and the antenna radiation part is arranged on the antenna support; and the feeding grounding branch node is connected with the antenna radiation part via the feeding point and the grounding point:

wherein the antenna radiation part comprises a monopole part a coupling gap, a coupling branch node, an open stub, and a grounding branch node; wherein:

the monopole part is connected to the feeding point, extends from the feeding point and along a front surface of the antenna support, changes its extending direction on to a top surface of the antenna support, and extends from the top surface of the antenna support to form a transverse radiation patch;

the coupling branch node is connected to the grounding branch node, and extends from the grounding branch node along the top surface of the antenna support to form a lateral branch node; the lateral branch node is separated from the transverse radiation patch of the monopole part via the coupling gap;

the open stub is connected to the grounding branch node, extends from the grounding branch node and along the top surface of the antenna support, and changes its extending direction on to a right surface of the antenna support; and the grounding branch node is connected to the coupling branch node and the open stub, extends from the top surface of the antenna support, change its extending direction on to the front surface of the antenna support, and then is connected to the feeding grounding branch node.

8. The terminal according to claim 7, wherein the MIMO antenna comprises a dual inverted-L-shape printed stub arranged between the single antennas; and the dual inverted-L printed stub is configured to shield high-frequency coupling between the single antennas.

9. The terminal according to claim 7, wherein, when the feeding grounding branch node is connected to the antenna radiation part via the feeding point, the feeding grounding branch node is also configured to provide the antenna radiation part with a power feed source of the PCB and to provide the antenna radiation part with a ground voltage of the PCB.

10. The terminal according to claim 7, wherein the at least two single antennas of the MIMO antenna are arranged symmetrically on a top of the PCB.

11. A method for improving isolation of a multiple-input multiple-output (MIMO) antenna, which arranges the MIMO antenna comprising at least two single antennas on a printed circuit board (PCB), the method comprising:

arranging an antenna support, a feeding grounding branch node used for shielding low-frequency coupling between the single antennas, a feeding point, a grounding point and an antenna radiation parts; wherein the antenna support is arranged on the PCB, and the antenna radiation part is arranged on the antenna support; and the feeding grounding branch node is connected to the antenna radiation part via the feeding point and the grounding point;

wherein the antenna radiation part comprises a monopole part, a coupling gap, a coupling branch node, an open stub, and a grounding branch node; wherein:

the monopole part is connected to the feeding point, extends from the feeding point and along a front surface of the antenna support, changes its extending direction on to a top surface of the antenna support, and extends from the top surface of the antenna support to form a transverse radiation patch;

the coupling branch node is connected to the grounding branch node, and extends from the grounding branch node along the top surface of the antenna support to form a lateral branch node; the lateral branch node is separated from the transverse radiation patch of the monopole part via the coupling gap;

the open stub is connected to the grounding branch node, extends from the grounding branch node and along the top surface of the antenna support, and changes its extending direction on to a right surface of the antenna support; and the grounding branch node is connected to the coupling branch node and the open stub, extends from the top surface of the antenna support, change its extending direction on to the front surface of the antenna support, and then is connected to the feeding grounding branch node.

12. The method according to claim 11, further comprising:

arranging a dual inverted-L printed stub between the single antennas;

shielding high-frequency coupling between the single antennas via the dual inverted-L printed stub.

13. The method according to claim 12, further comprising:

radiating a low-frequency broad band by a monopole part, a coupling gap, a coupling branch node of the antenna radiation part;

radiating a high-frequency broad band by the monopole part, the coupling gap, an open stub, and a grounding branch node of the antenna radiation part.

14. The method according to claim 11, further comprising:

when the feeding grounding branch node is connected to the antenna radiation part via the feeding point, providing, by the feeding grounding branch node, a power feed source of the PCB to the antenna radiation part, and providing, by the feeding grounding branch node, a ground voltage of the PCB to the antenna radiation part.

15. The method according to claim 14, further comprising:

radiating a low-frequency broad band by a monopole part, a coupling gap, a coupling branch node of the antenna radiation part;

radiating a high-frequency broad band by the monopole part, the coupling gap, an open stub, and a grounding branch node of the antenna radiation part.

16. The method according to claim 11, further comprising:

radiating a low-frequency broad band by a monopole part, a coupling gap, a coupling branch node of the antenna radiation part;

radiating a high-frequency broad band by the monopole part, the coupling gap, an open stub, and a grounding branch node of the antenna radiation part.

* * * * *